US005830032A

United States Patent [19]

Campbell

[11] Patent Number: 5,830,032

[45] Date of Patent: Nov. 3, 1998

[54] ARCHITECTURAL BLOCKS

[76] Inventor: John Holland Campbell, 308 Trailwood La., Lafayette, La. 70508

[21] Appl. No.: 588,335

[22] Filed: Jan. 18, 1996

[51] Int. Cl.[6] ..... A63H 3/08

[52] U.S. Cl. ..... 446/128; 446/126; 446/117; 446/108

[58] Field of Search ..... 446/85, 118, 124, 446/126, 128, 117, 108; D21/108

[56] References Cited

U.S. PATENT DOCUMENTS

| | | | |
|---|---|---|---|
| D. 290,476 | 6/1987 | Ryaa et al. | D21/108 |
| D. 312,104 | 11/1990 | Andersen | D21/108 |
| D. 312,486 | 11/1990 | Andersen | D21/108 |
| D. 315,580 | 3/1991 | Andersen | D21/108 |
| D. 343,426 | 1/1994 | Sher | 446/128 |
| D. 345,591 | 3/1994 | Krentz | D21/108 |
| D. 355,452 | 2/1995 | Glynn | D21/108 |
| D. 355,454 | 2/1995 | Glynn | D21/108 |
| D. 355,940 | 2/1995 | Glynn | D21/108 |
| D. 361,098 | 8/1995 | Glynn | D21/108 |
| 3,132,443 | 5/1964 | Kuhn | 446/126 |
| 4,030,236 | 6/1977 | Schnabel | 446/128 |
| 4,129,975 | 12/1978 | Gabriel | 446/126 |
| 4,698,023 | 10/1987 | Marino | 434/259 |
| 4,877,407 | 10/1989 | Du Pont | 434/302 |
| 5,186,672 | 2/1993 | Tung | 446/95 |
| 5,344,143 | 9/1994 | Yule | 446/128 |
| 5,354,224 | 10/1994 | Ishiyama | 446/117 |

FOREIGN PATENT DOCUMENTS

| | | | |
|---|---|---|---|
| 511666 | 12/1920 | France | 446/124 |
| 994878 | 11/1951 | France | 446/128 |
| 853272 | 10/1952 | Germany | 446/124 |
| 545826 | 9/1957 | Italy | 446/118 |
| 88/03828 | 6/1988 | WIPO | 446/124 |

OTHER PUBLICATIONS

"LEGO" product catalog, 1978.

*Primary Examiner*—Robert A. Hafer
*Assistant Examiner*—Jeffrey D. Carlson

[57] ABSTRACT

A set of novel architectural design blocks is disclosed. The design blocks may be used for education, instruction, and design purposes. Generally, the blocks contain a post member positioned in a generally upright position. Also, a beam member cooperating with the post member is provided and the beam member is positioned in a generally lateral position relative to the post member. Additionally, a rafter member cooperating with the post member and the beam member is included, with the rafter positioned in a sloping position relative to the post member. The post member comprises a 3 unit by 3 unit lateral surface area such that 9 unit members are formed therein with said center unit member being void so that 8 unit members are formed by said post member. The rafter will have in the preferred embodiment an 12 unit run by 8 unit rise.

13 Claims, 9 Drawing Sheets

ARCHITECTURAL BLOCKS

BACKGROUND OF THE INVENTION

This invention relates to architectural blocks. More particularly, but not by way of limitation, the invention relates to architectural blocks which are used for education, instruction, and design purposes.

Over the years, various types of building blocks have been designed. Simple blocks of different sizes and shapes have been used in order to assist small children in their educational development. Other types of blocks have been developed that are more complicated in structure and detail. These more advanced designs can be used by students of architecture in order to analyze the relationship of structure, space, and aesthetics. Some type of design blocks may be used by professional architects and designers in order to study structural concepts and build models and prototypes for presentations.

For instance, the blocks sold under the trademark "Lego's" utilizes modular components that are adapted to cooperate with one another but there are no guiding principles, and the blocks are designed for use by children. Numerous types of bulky structures are possible, but the users' creativity is limited.

More advanced modular blocks are also available. For instance, in U.S. Pat. No. 3,546,792 to R. Sherman which teaches a set of interlocking modular design blocks for architecture students as well as the young. Another example is seen in U.S. Pat. No. 5,221,223 to G. Kao which discloses an angled set of building blocks that is intended to illustrate the principles of using angled building blocks and not to rigidly define the structure.

Despite the numerous types of blocks available, the prior art design blocks limit the architectural student in structure and design. Therefore, there is a need for a set of design blocks which will teach students and children the nature of cooperation between post, beams, and rafters. There is also a need for a set of blocks that will allow for the creation and construction of advanced design structures thereby enhancing the learning of the student as well as increasing the sophistication of the building. The invention herein disclosed will have an impact on the designs and schematics of numerous engineering and architectural projects, of problem solving nature, in the future.

SUMMARY OF THE INVENTION

A modular set of design blocks is disclosed. The set of blocks comprises a primary block having a first planar surface and a second planar surface, with the first and second planar surface being formed in a square. The sides of the design blocks will include a side having a 3 unit size by a 3 unit size horizontally so that a 9 inner cell primary block is formed. In the preferred embodiment, the center inner cell unit module is void. The construction begins on a flat surface and builds to an undetermined height.

The design blocks further comprise a beam member having a length in multiples of 3 units (considered as a module), with the beam member further including a first end and a second end that cooperate with the primary block. The design blocks further include a rafter member having a length of 3 units run along with a slope of 2 units rise vertical modules. The design blocks further include a rafter member having a span length in multiples of 3 (remember, that 1 module horizontally equals 3 units horizontally) while still maintaining a slope equal to 3 units of run and 2 units of rise.

Opposite slopes are also available. The rafter member has a first end and a second end that cooperate with the primary block. The primary block, beam member and rafter member will have contained thereon means for joining each together in a cooperating fashion.

The design blocks may further contain a second rafter member having a length in multiples of 3 modules, with the second rafter member defining a positive slope of 3 units horizontally to 2 units vertically and a negative slope of 2 units vertically to 3 units horizontally thereby forming a vaulted member. The second rafter member will have a first and second end, with the first and second end having a connector section of length of 1 unit volume adapted to be received with the first and/or second planar surface of the primary post.

The design blocks may also contain an arch member having a top side and an underside, the arch member having a length in multiples of 3 units with the arch member having a first and second end, with said first and second end having a connector section of length of 1 unit and adapted to be received with the first and/or second planar surface of the primary post. In one embodiment, the underside is a curved surface.

In one embodiment, the primary post block includes a height of one unit and wherein said beam has a height of one unit, and wherein the primary block and the beam are attached with the joining means. Additionally, the primary post may include a height of one unit and wherein the rafter has a height of one unit and wherein the primary post and the rafter are attached with the joining means. Also, the primary post may include a height of one unit and wherein the second rafter member has a height of one unit and wherein the primary post and the second rafter are attached with the joining means. From the perimeter of one block to the perimeter of another block (at some determined modular distance), the planar surfaces from the first end to the second end could surface on the same horizontal plane.

An advantage of the present system includes a three-dimensional modular post and beam and rafter system, that is primarily precision-geometry oriented. Another advantage of the present invention includes the ability of individuals to express themselves, solve problems in space planning, and to retain new information about the basics of structure inherent in most architectural and engineering accomplishments. Yet another advantage is that the system allows the user to understand the exterior and interior qualities and limitations of a structure.

A feature of the present invention includes the blocks and pieces stack to lock members in place. Another feature includes rafter members can also be used for supporting lateral forces necessary for constructing any tall structures or long spans. Yet another feature is that the blocks are designed to accept eight (8) different options in one unit of vertical volume. In other words, the beam and rafter members project from the perimeter units of the post block, some determined number of modules, to another post block with eight useful perimeter units. Where beams and rafters do not occupy all perimeter unit options, block filler pieces will be used for column solidity.

Another feature is the thickness of the blocks varies from ½ unit size, to one unit size, to two units, to three units vertically. Some of the blocks possess different areas of thickness by excluding certain cells within the member. The center of the block system is usually and primarily void to help instruct the system-user. By using the perimeter points of the block, the system-user is guaranteed to maintain equal bays of construction and structure.

Still yet another feature includes sloped (also referred to as pitched or vaulted) pieces which maintain throughout an equivalency of eight unit rise with a twelve unit run, with positive and negative equal slopes. This slope applies directly to acceptable uses in architecture for roof slopes, cross-lateral bracing and stairs. All of the various members herein described may be digitized and placed within a software program so that architecture student can conceive structures via computer aided design techniques.

DESCRIPTION OF THE PREFERRED EMBODIMENTS

Figure 1A:
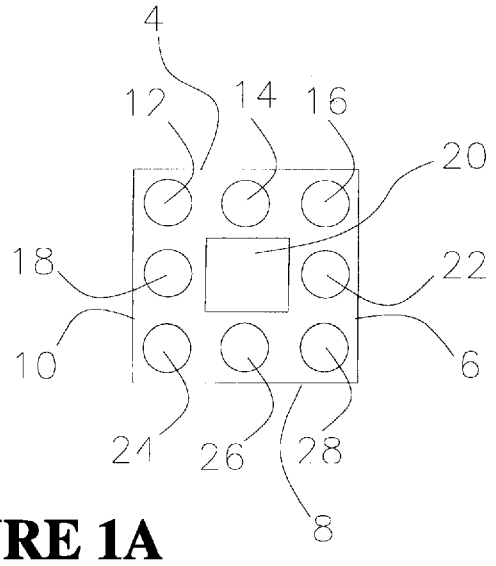
FIG. 1A is the plan view of the primary block of the present invention.

Referring now to FIG. 1A, a plan view of the primary block 2A of the present invention is shown. Generally, the primary block 2A (also referred to as a post 2A) has four sides 4, 6, 8, and 10 of equal length so that a square is thereby formed. The primary block 2A will have nine individual units 12, 14, 16, 18, 20, 22, 24, 26, and 28, with the center unit 20 being void in the preferred embodiment. A row consists of a horizontal linear arrangement for instance the units 16, 22 and 28 make up one row. With eight usable units per block, the designer has eight different options to slope or beam in one unit of vertical volume and this can multiply as the single unit is divided. One unit of vertical volume or horizontal volume is referred to as a cell.

Figure 1B:
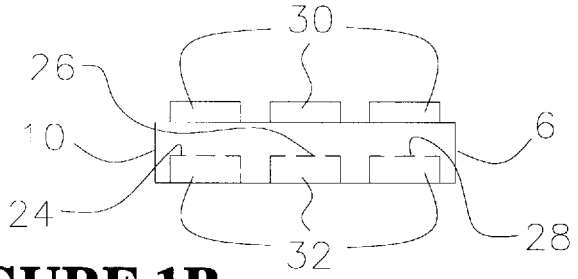
FIG. 1B is single unit high elevation view of the primary block of FIG. 1A.

As seen in FIG. 1B, a single unit high elevation view of the primary block 2B from FIG. 1A is shown. As seen, the sides 6 and 10 are of equal height, and also the individual sides of unit 24, 26, 28 form individual squares. This embodiment contains 3 rows namely 12-18-24; 14-void-26; and, 16-22-28.

FIG. 1B also depicts the joining means 30 for joining the various blocks, beams and rafters together. The joining means 30 cooperate with the cavities 32 which are contained on the underside of the various blocks. The individual joining means 30 are generally of cylindrical construction that are adapted into the individual rectangular cavities as is well understood by those of ordinary skill in the art. It should be noted that other joining means 30 may be employed such as a hook and loop fastener, or X's or square peg extrusions which is known under the trademark name as Velcro. The joining means 30 may be employed on all the blocks, beams, and rafters described herein. For beams and rafters, the joining means 30 are employed primarily at the first end and the second end, but are occasionally included at other specified upper planar unit locations. All beams and rafters posses a continuous negative cavity to allow for spanning over the joining means 30.

Figure 1C:
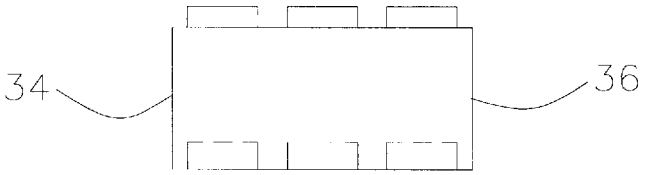
FIG. 1C is a two unit high elevation view of the primary block of FIG. 1A.

Referring now to FIG. 1C which depicts a two unit high elevation view of the primary block 2C from FIG. 1A. The sides 34 and 36 are of two units high (compare the one unit high sides 10 and 6). The block 2C will also contain the joining means 30 and cavity 32. This embodiment will contain 8 additional units as well as 3 additional rows to be considered as one module. It should be noted that with reference to the scale, it is possible to include with all members herein disclosed a preferred ¼" scale and/or ½" scale; however, the invention is not to be limited to only these proportional scales. Also, it is possible to have modular components made up of individual units, or combinations of two or more units, generally at 37 of FIG. 11.

Figure 2A:
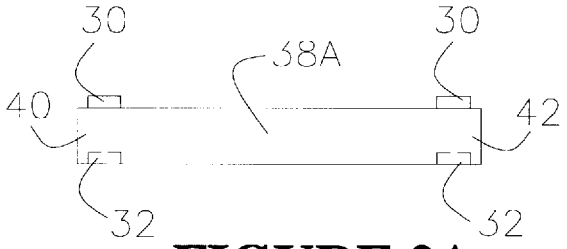
FIG. 2A is a two unit high elevation view of the beam member of the present invention.

The following beam and rafter embodiment explanations are primary examples of a feature of the invention; however, unlimited variations of these modular members are possible. A two unit high beam member 38A is depicted in FIG. 2A. The beam members 38 will also abide by multiple rules in dimension and will have a span (length) in multiples of 3 units, ergo: 3 units, 6 units, 9 units, 12 units, 15 units. The beam members will have a first end 40 and a second end 42, with the first end 40 and second end 42 having thereon the previously described joining means 30 and cavity 32. It should be noted that in FIG. 2A, the ends 40 and 42 are two units in height continuous from one end to the next, and the thickness of the beam is one unit (as seen in FIG. 2D) even though other thicknesses are available.

Figure 2B:
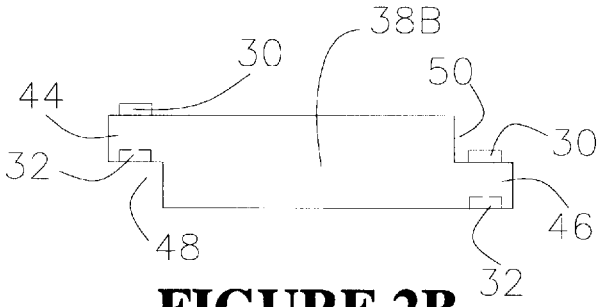
FIG. 2B is a second embodiment of the beam member of the FIG. 2A.

Referring to FIG. 2B, a second embodiment of two unit high beam member 38B is shown. The beam member 38B has a first end 44 and a second end 46, with the first end having a void bottom cell 48 as one option for both ends and the second end 46 having a void top cell 50 with another option for both ends and a combination of the two end options. It should be noted that ends 44 and 46 have contained thereon the joining means 30 and associated cavity 32.

Figure 2C:
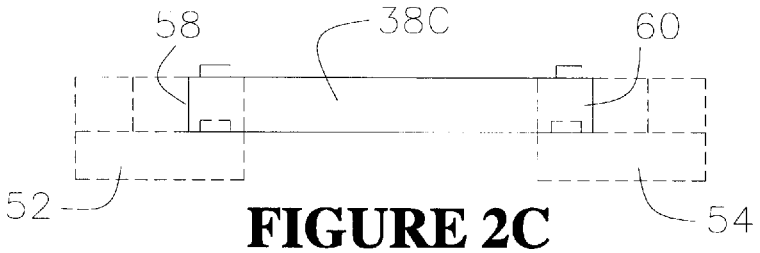
FIG. 2C is an elevation of a single unit high beam member attached to blocks.
Figure 2D:
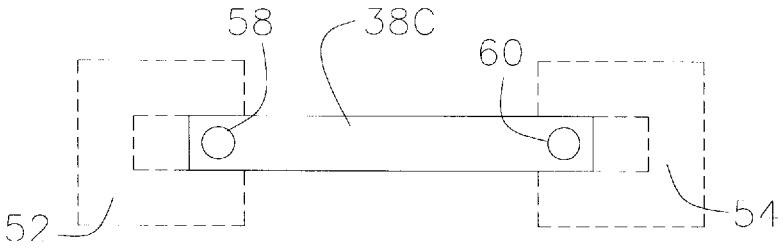
FIG. 2D is a plan view of the beam member of FIGS. 2C and 2A.

In FIG. 2C, a unit high beam member 38C is depicted that is attached to blocks 52 and 54. The beam member 38C has a first end 58 and a second end 60 that will have contained thereon the joining means 30 and cavity 32 previously described. The blocks 52 and 54 have the top row of cells void so that the ends 58 and 60 are adapted to be received within the row of void cells with the joining means 30. The FIG. 2D depicts the plan view of FIG. 2C and illustrates the top row of void cells within blocks 52 and 54.

Figure 3A:
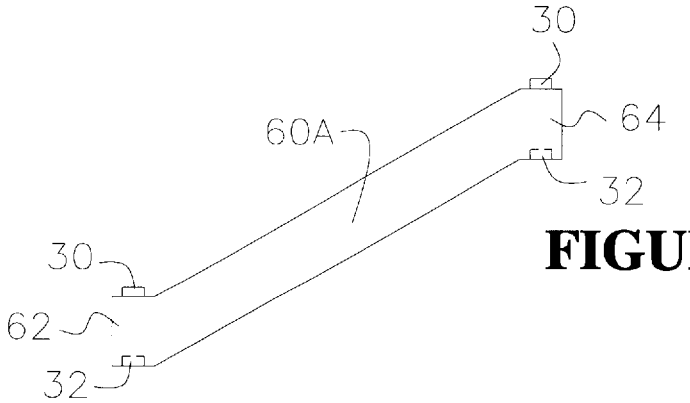
FIG. 3A is a two vertical unit side elevation view of the rafter member of the present invention.

Referring to FIG. 3A, a side elevation of the rafter member 60A is illustrated. The rafter member 60 is two units high and has a first end 62 and a second end 64, with the ends 62 and 64 having the previously described joining means 30 and cavity 32. The rafter member 60 has a 2 unit rise by 3 unit run to provide it with a uniform slope. The primary uses of the rafter members 60A include cross-lateral support, rafters, trusses, stairs, ramps, roofs, etc.

Figure 3B:
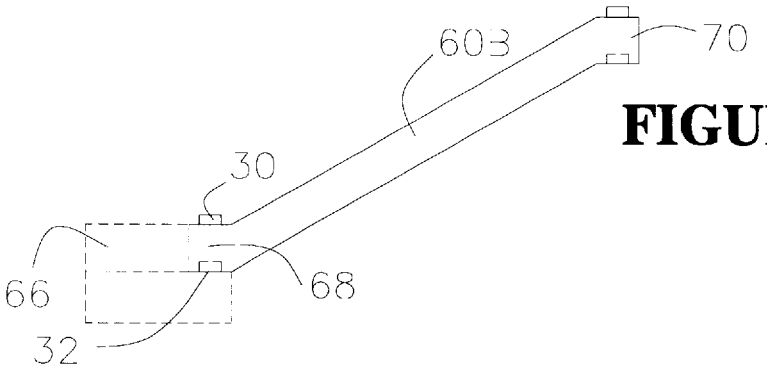
FIG. 3B is a one unit high side elevation view of the rafter member of the present invention.
Figure 3C:
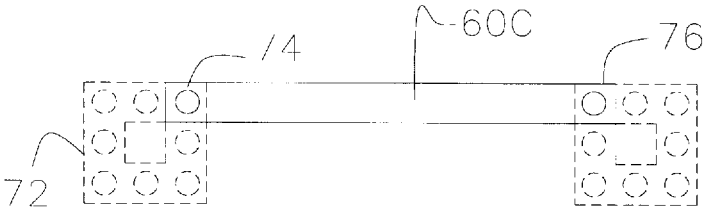
FIG. 3C is a plan view of the rafter member of FIGS. 3A and 3B.
Figure 3D:
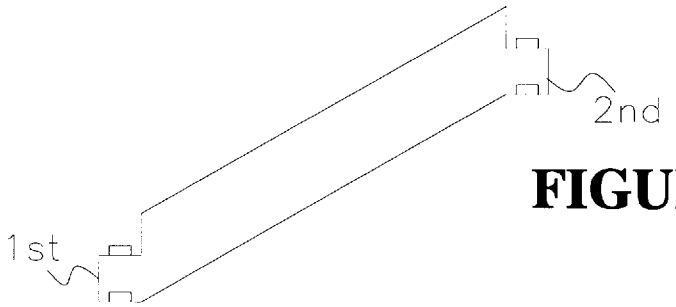
FIG. 3D is an elevation view of a rafter member necessary to help define an accurate hip ridge location.

The FIG. 3B depicts the rafter member 60B that is one unit high along with the block 66, with the rafter member having a first end 68 and a second end 70. As shown in FIG. 3B, the first end 68 is received within the top row of void cells of the block 66. A plan view of the rafter 60C that is received within the top row of void cells of the block 72 is illustrated. The rafters 60C will have the first end 74 and second end 76 that will also contain thereon the joining means 30 and cavity 32. If the designer so chooses, a similar block may be positioned at the opposite ends 76. The FIG. 3D depicts an elevation view of a rafter member necessary to help define an accurate hip ridge location. By protruding outward any direction from the perimeter of the block to the perimeter of another block, the modular continuity is maintained.

Figure 4A:
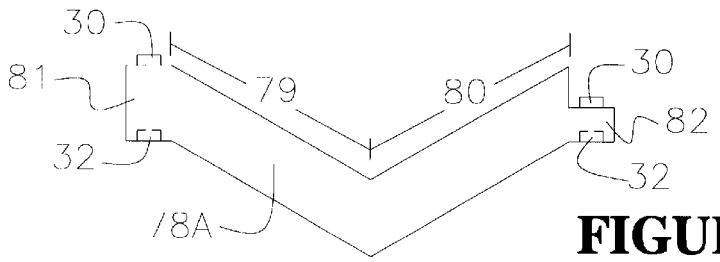
FIG. 4A is a side elevation view of a double slope rafter member of the present invention.

The system herein disclosed also allows for a double slope vaulted rafter 78 as shown in FIGS. 4A–4E. Specifically, the rafter 78A (which is two units high) will have its first section with negative slope and a second section with a positive slope which forms a "V" member. The length will again be in multiples of three units: 3, 6, 9, 12, 15 etc. The slope is also the constant 2 unit rise by 3 unit run designated by the numerals 79 and 80. The rafter 78A has a first end 81 and a second end 82 which both contain the joining means 30 and cavity 32. As seen in FIG. 4A, the end 81 is two units high. The end 82 is only one unit high, with the upper cell being void. The system herein disclosed allows for such variations so that many different structures may be built.

Figure 4B:
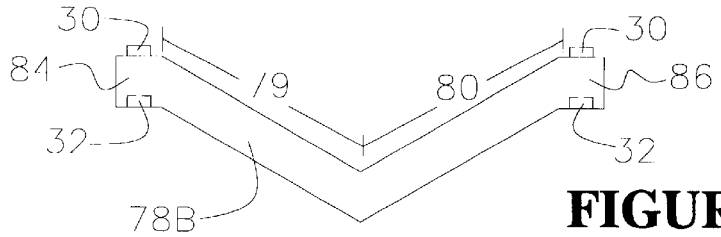
FIG. 4B is a one unit high side elevation view of a double slope rafter member with positive and negative sloping entities.
Figure 4C:
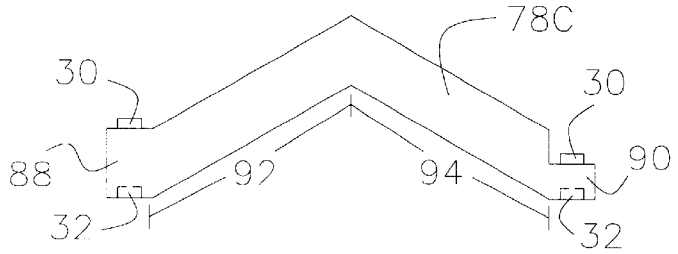
FIG. 4C is a side elevation view of another embodiment of a double slope rafter member.

Referring now to FIG. 4B, a one unit high side elevation of the double sloped rafter member 78B is shown. The rafter 78B has a first end 84 and a second end 86, with the ends 84, 86 containing the joining means 30 and cavity 32. Another variation of the double sloped rafter is seen in FIG. 4C wherein the rafter 78C is oriented in the opposite direction so that the rafter 78C forms a vault or folded plate roof line member. The rafter 78C will have a first end 88 and a second end 90 with the first end being two units high (as previously explained) while the end 90 is only one unit high so that the upper cell is void presenting three different options. The ends will contain the joining means 30 and cavity 32. The slope of both sections 92 and 94 will remain the constant 2 unit rise by 3 unit run.

Figure 4D:
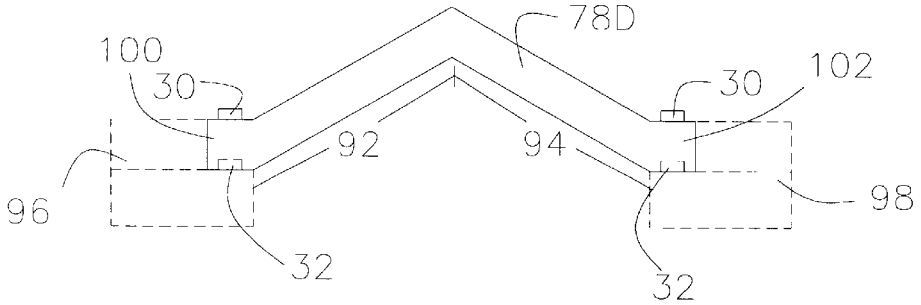
FIG. 4D is a one unit high side elevation view of a double slope rafter member attached to blocks.

The double rafter member 78D, as seen in FIG. 4D, will be one unit high and will be connected to the blocks 96 and 98. The blocks 96, 98 will have a first row of cells void. It should be noted that singular unit block pieces and various multiples of units in one block module can be used to accept a specified number of rafter and beam members. The vaulted rafter 78D has contained thereon the joining means 30 and cavity 32 at the first end 100 and second end 102. The first and second end 100, 102 are adapted to be received within the blocks 96, 98, respectively, and in particular within said voids. Also, note that the primary block is one unit vertical volume (referred to as a cell) so in some applications singular unit block pieces may be used to continue construction with fewer different pieces or members.

Figure 4E:
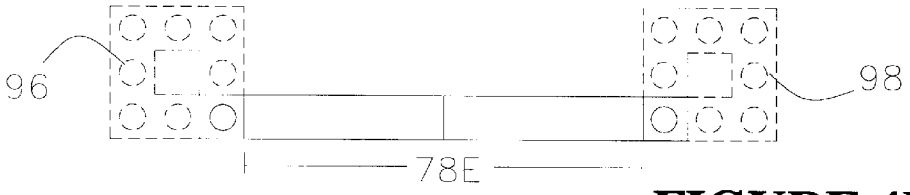
FIG. 4E is plan view of the double slope rafter member of FIG. 4D.

The FIG. 4E is a plan view of the double slope rafter 78E illustrating wherein a rafter member may be provided with the blocks 96 and 98. The center cell of the blocks 96 and 98 are void.

Figure 5A:
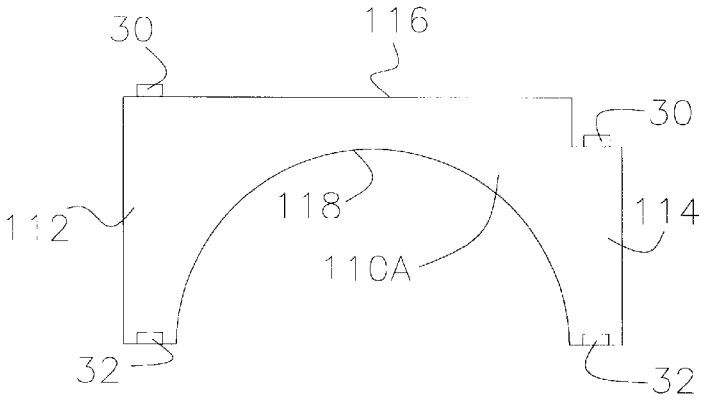
FIG. 5A is a side elevation view of an arch member of the present invention.
Figure 5B:
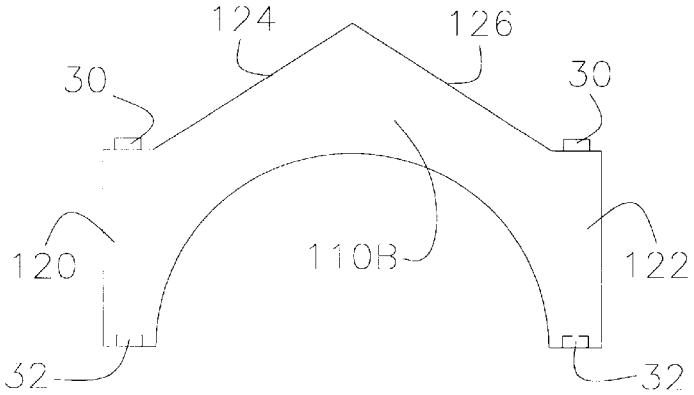
FIG. 5B is a side elevation view of a second embodiment of a gabled arch member of the present invention.
Figure 5C:
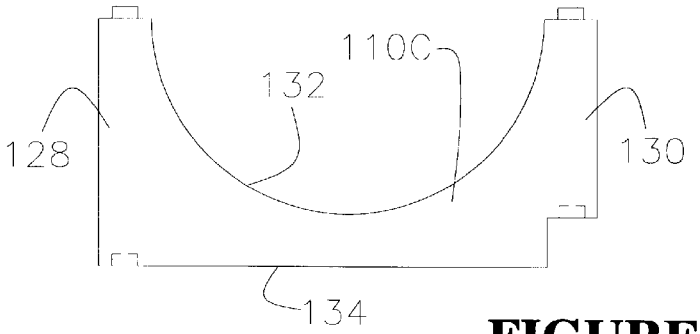
FIG. 5C is a side elevation view of a third embodiment of an arch member of the present invention to help achieve circle openings in structure walls.

The arch member 110 of the present invention is illustrated in FIGS. 5A–5C. The arch member 110A has a first end 112 and a second end 114, with the first end option being 4 units high and the second end option 112 being three units high. The ends 112 and 114 have the joining means 30 and cavity 32. The top side 116 of arch member 110A is horizontal with the underside 118 being arched. Both the top side 116 and the underside extend from the first end 112 to the second end 114 in multiples of 3 units.

In FIG. 5B, a second embodiment of the arch member 110B. In this embodiment, the arch member 110B has a first end 120 and a second end 122 with both ends being of 3 unit high construction. Further, the ends 120, 122 have contained thereon the joining means 30 and cavity 32 previously described. The top side of the gabled arch member 110B is vaulted (double slope) having sides 124 and 126. The underside is formed in an arch similar to the underside 118.

Yet another embodiment is shown in FIG. 5C wherein the arch member 110C is four units high, with ends 128 and 130. The top side 132 is actually formed in an arch, with the bottom side 134 being horizontal. In this embodiment, the bottom cell of end 130 is void as an additional option.

Figure 6A:
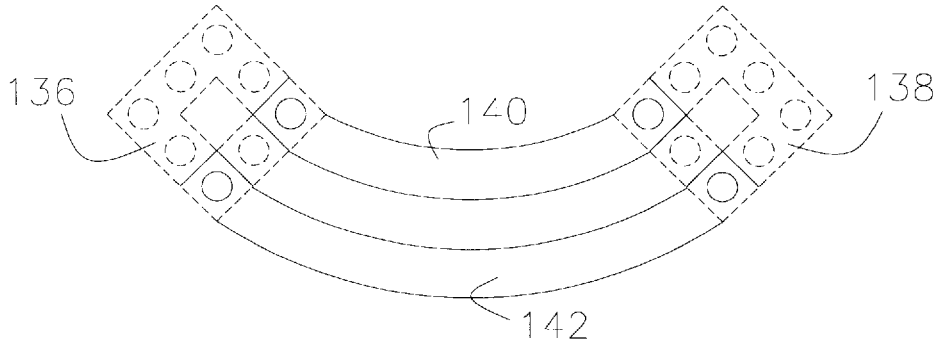
FIG. 6A is a plan view of a rounded corner piece connecting to primary blocks that abide by modular rules.
Figure 6B:
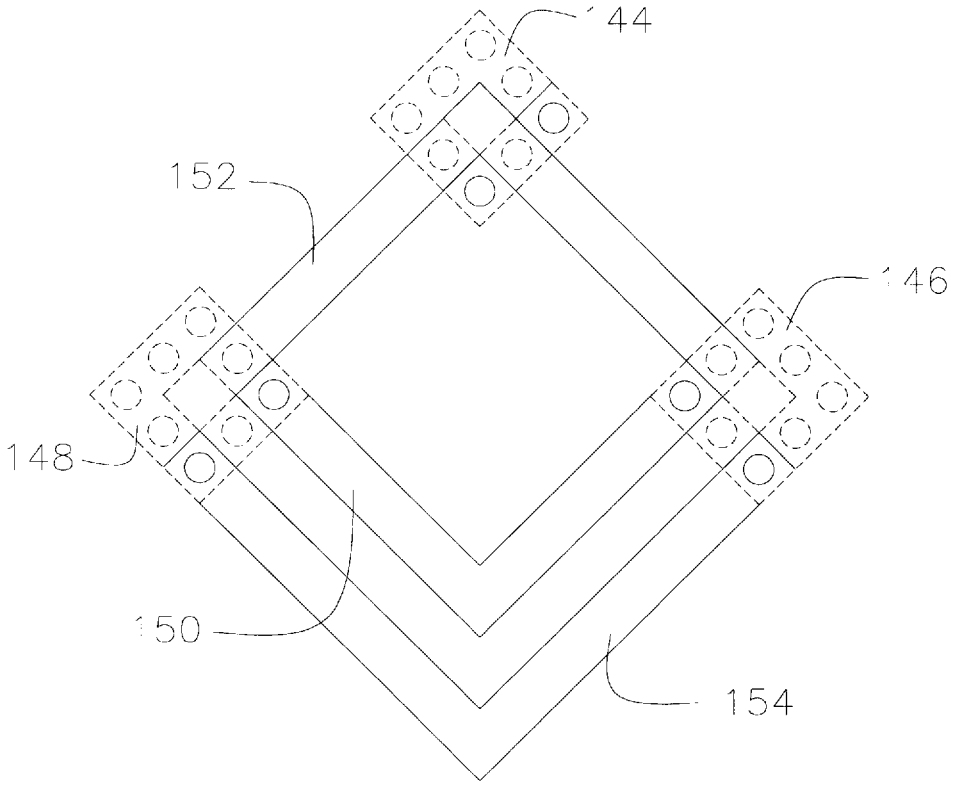
FIG. 6B is a plan view of a squared-off corner piece connecting to primary blocks.

Referring to FIG. 6A and 6B, an embodiment of the present systems utilizing corner pieces is shown. In particular, FIG. 6A depicts a first block 136 and a second block 138 that are interconnected with a rounded corner member 140 and 142 with the corners 140, 142 being adapted to be received within the blocks 136 and 138 with the joining means 30 and cavity 32 as previously described. The radial curvature will be a 6–7 unit radius, or a 7–8 unit radius, or an 8–9 unit radius to remain applicable to modular guideline specifications.

In FIG. 6B, the blocks 144, 146, and 148 are interconnected by the corner pieces 150, 152, and 154 wherein said corner pieces are joined with the blocks with the joining means 30 and cavity 32. Moreover, the corner pieces 150, 152, and 154 are squared off. As depicted in FIG. 6B, the corner piece 150 is smaller, and corner piece 152 is mid-sized and the corner piece 154 is larger.

Figure 7B:
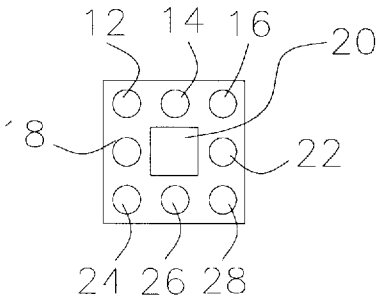
FIG. 7B is a plan view of the planar surface of the column of FIG. 7A.
Figure 7A:
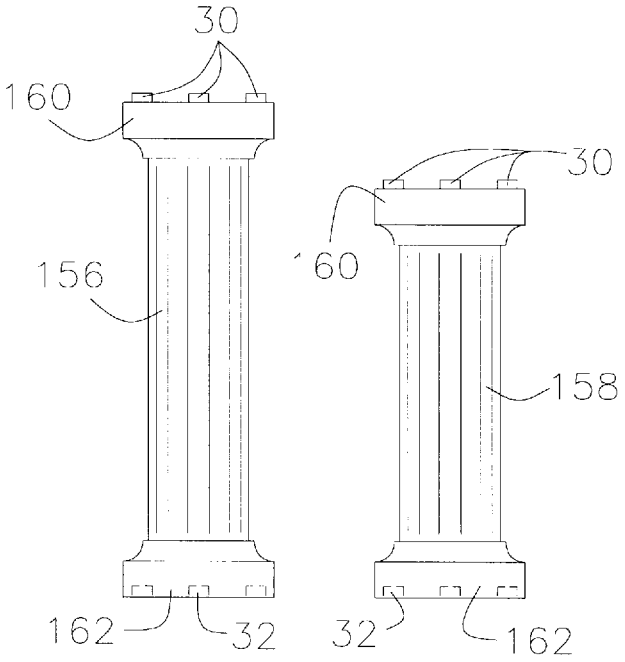
FIG. 7A is an elevation view of a column piece.

The FIG. 7A depicts column pieces 156, 158 that are of different heights. The column pieces 156, 158 will have a top surface 160 and a bottom surface 162 that will contain therein the joining means 30 and cavity 32 as previously described. As depicted in FIG. 7B, the top surface 160 will contain the cells 12, 14, 16, 18, 22, 24, 26, 28 similar to those of the primary block 2A of FIG. 1A.

Figure 8:
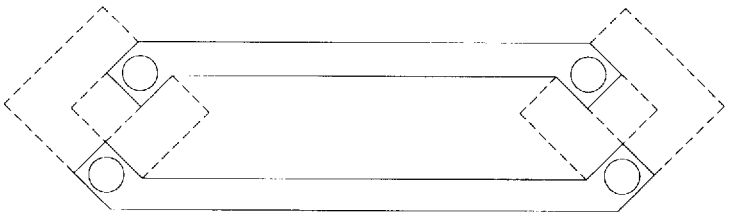
FIG. 8 is a plan view of a 45 degree member.
Figure 9:
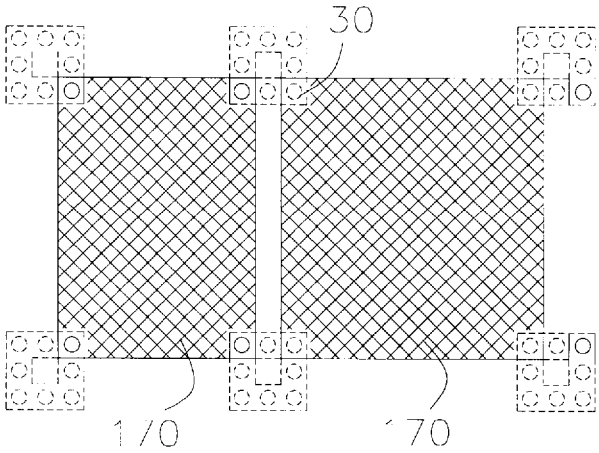
FIG. 9 is a plan view of a floor member.
Figure 10:
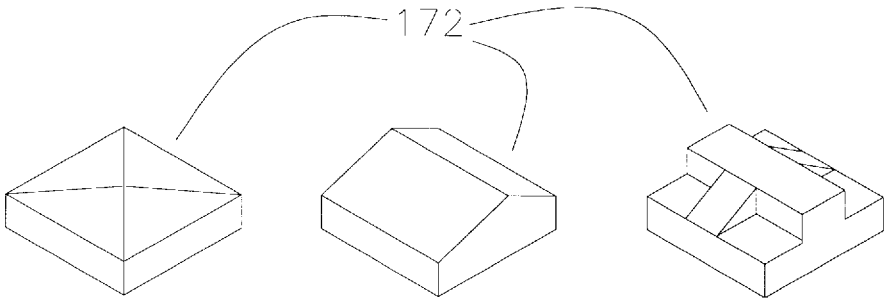
FIG. 10 is a illustrated view of a cap piece.

Also shown is FIG. 8 is a plan view of a 45 degree member. FIG. 9 is a plan view of a floor member 170. FIG.

Figure 11:
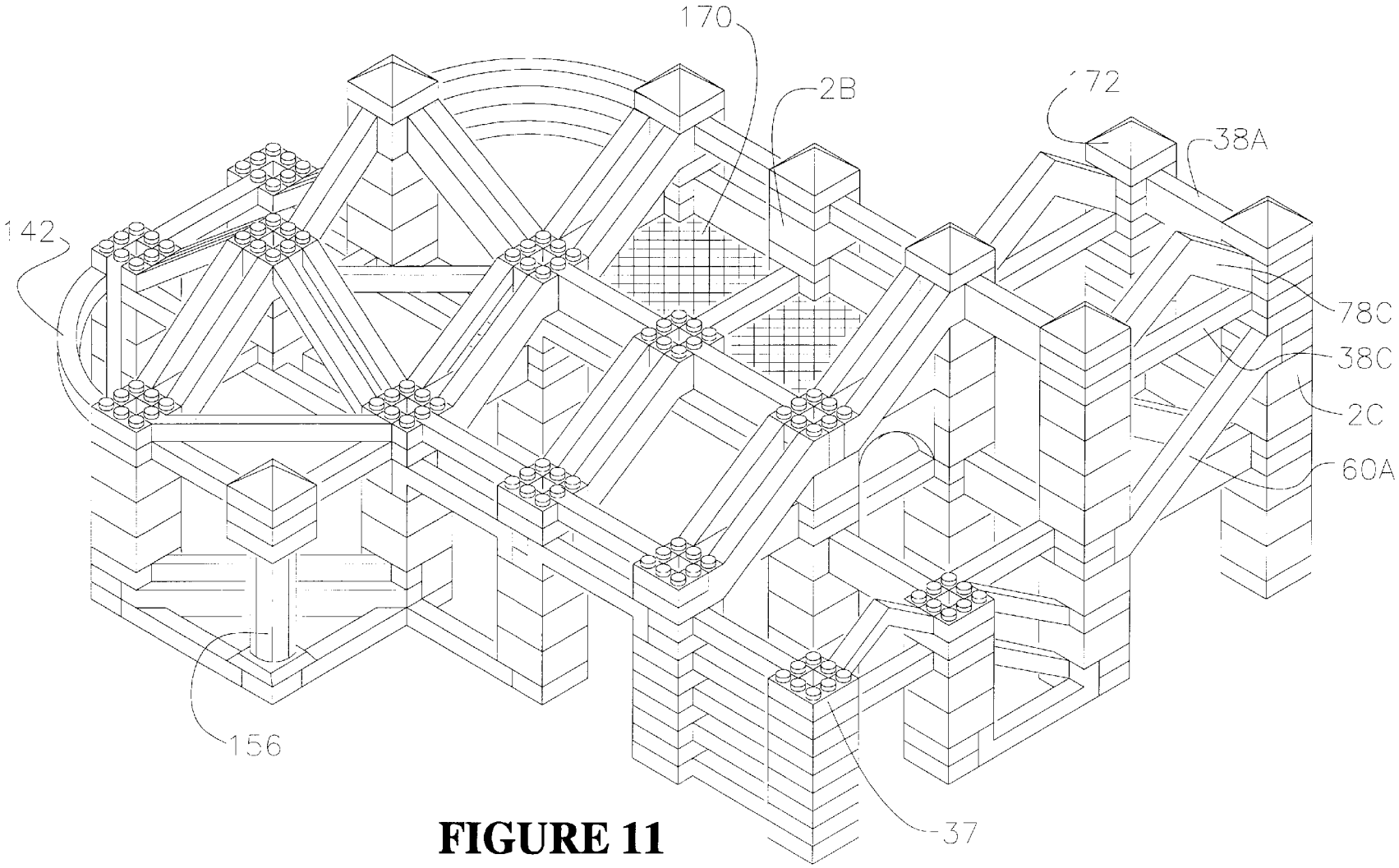
FIG. 11 is an illustration of a structure constructed in accordance with the teachings of the present invention.

10 is an axonometric view of a cap pieces 172. Finally, FIG. 11 is an illustration of a structure constructed in accordance with the teachings of the present invention.

Changes and modifications in the specifically described embodiments can be carried out without departing from the scope of the invention which is intended to be limited only by the scope of the appended claims.

I claim:

1. A set of building blocks a primary block having a first planar surface and a second planar surface, said primary block having a width, thickness and height so that sides are formed and wherein the sides of said primary block are a 3 by 3 unit, and wherein said center of said primary block is a void, said void measuring 1 unit by 1 unit so that said primary block forms an eight perimeter unit and wherein said void has a first opened end on said first planar surface and a second opened end on said second planar surface;

a beam member having a length in a multiple of 3 units, with said beam member having a first and second end, with said first and second end having a connector section of length of 1 unit and adapted to be received with said eight perimeter unit on said first and second planar surface of said primary block;

a first rafter member having a length in a multiple of 3 units, with said rafter defining a slope of 3 units horizontally to 2 units vertically, with said rafter member having a first and second end, with said first and second end having a connector section of length of 1 unit and adapted to be received with said eight perimeter unit on said first and second planar surface of said primary block;

a second rafter member having a length in a multiple of 3 units, with said second rafter member defining a positive slope of 3 units horizontally to 2 units vertically and a negative slope of 3 units horizontally to 2 units vertically, with said second rafter member having a first and second end, with said first and second end having a connector section of a length of 1 unit and adapted to be received with said eight perimeter unit on said first and second planar surface of said primary block;

an arch member having a top side and an underside, said arch member having a length in a multiple of 3 units with said arch member having a first and second end, with said first and second end having a connector section of length of 1 unit and adapted to be received with said eight perimeter unit on said first and second planar surface of said primary block and wherein said underside is a curved surface.

2. The set of blocks of claim 1 wherein said first planar surface of said primary block contains means for joining the set of blocks, and wherein said second planar surface of said primary block contains means for joining the set of blocks.

3. The set of blocks of claim 2 wherein said connector end of said beam member contains means for joining the set of blocks.

4. The set of claim 3 wherein said first and second end of said first rafter member contains means for joining the set of blocks.

5. The set of blocks of claim 4 wherein said first and second end of said second rafter member contains means for joining the set of blocks.

6. The set of blocks of claim 5 wherein said first and second end of said arch member contains means for joining the set of blocks.

7. A set of designing blocks comprising:

a primary block having a first planar surface and a second planar surface, with said first and second planar surfaces being formed in a square, with said block having a 3 unit size by a 3 unit size so that a 9 inner module primary block is formed, and wherein the center inner module has a first opened end on said first planar surface and a second opened end on said second planar surface so that an eight perimeter unit and a void is formed;

a beam member having a length in multiples of 3 units, said beam member further including a first end and a second end that cooperate with said eight perimeter unit;

a rafter member having a span of 3 units and a slope of 2 units rise by 3 units run, with said rafter member having a first end and a second end that cooperate with said eight perimeter unit;

means, positioned on said eight perimeter unit, for joining said primary block, beam member and rafter member;

a second rafter member having a length in multiples of 3 units, with said second rafter member defining a positive slope of 3 units horizontally to 2 units vertically and a negative slope of 3 units horizontally to 2 units vertically, with said second rafter member having a first and second end, with said first and second end having a connector section of length of 1 unit and adapted to be received with said eight perimeter unit on said first and second planar surface of said primary block;

an arch member having a top side and an underside, said arch member having a length in multiples of 3 units with said arch member having a first and second end, with said first and second end having a connector section of length of 1 unit and adapted to be received with said eight perimeter unit on said first and second planar surface of said primary block.

8. The design blocks of claim 7 wherein said primary block includes a height (side) of one unit and wherein said beam has a height (side) of one unit, and wherein said primary block and said beam are attached with said joining means.

9. The design blocks of claim 7 wherein said primary block includes a height (side) of one unit and wherein said rafter has a height (side) of one unit and wherein said primary block and said beam are attached with said joining means.

10. The design blocks of claim 7 wherein said primary block includes a height (side) of one unit and wherein said second rafter member has a height (side) of one unit and wherein said primary block and said second rafter are attached with said joining means.

11. The design blocks of claim 7 wherein said arch member comprises:

a top side having an arched surface.

12. The design blocks of claim 7 wherein said arch member comprises:

a bottom side having an arched surface.

13. The design blocks of claim 12 further comprising:

a corner piece attached to said primary block.

* * * * *